US010684579B2

(12) United States Patent
Fujishiro et al.

(10) Patent No.: US 10,684,579 B2
(45) Date of Patent: Jun. 16, 2020

(54) IMAGE FORMING APPARATUS AND SHEET FEEDING METHOD

(71) Applicant: Brother Kogyo Kabushiki Kaisha, Nagoya-shi, Aichi-ken (JP)

(72) Inventors: Kotaro Fujishiro, Nagoya (JP); Tatsuya Koyama, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/286,909

(22) Filed: Feb. 27, 2019

(65) Prior Publication Data

US 2019/0265619 A1 Aug. 29, 2019

(30) Foreign Application Priority Data

Feb. 28, 2018 (JP) ..... 2018-035643

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/657* (2013.01); *G03G 2215/2035* (2013.01)

(58) Field of Classification Search
CPC ..... G03G 15/2039; G03G 15/2053
See application file for complete search history.

(56) References Cited

U.S. PATENT DOCUMENTS

| | | | | |
|---|---|---|---|---|
| 8,948,640 | B2 | 2/2015 | Takeuchi et al. | |
| 10,012,932 | B2 | 7/2018 | Ishigaya et al. | |
| 2013/0202324 | A1 | 8/2013 | Takeuchi et al. | |
| 2017/0212457 | A1 | 7/2017 | Ishigaya et al. | |
| 2017/0363997 | A1* | 12/2017 | Kamo | G03G 15/2039 |

FOREIGN PATENT DOCUMENTS

| | | | |
|---|---|---|---|
| JP | 2002-333806 | A | 11/2002 |
| JP | 2013-160980 | A | 8/2013 |
| JP | 2015-175903 | A | 10/2015 |
| JP | 2017-134111 | A | 8/2017 |

* cited by examiner

*Primary Examiner* — David M. Gray
*Assistant Examiner* — Andrew V Do
(74) *Attorney, Agent, or Firm* — Banner & Witcoff, Ltd.

(57) ABSTRACT

An image forming apparatus configured to, in a case where a temperature of a heating unit is lower than a first temperature when receiving a printing command, start feeding of a sheet based on an elapsed time which is time elapsed from a predetermined timing after start of heating of the heating unit until the temperature of the heating unit has reached a second temperature higher than a first temperature and lower than a fixing temperature, the feeding of the sheet being started based on a timing at which the temperature of the heating unit has reached the second temperature in a case where the elapsed time is equal to or longer than a first time, and the feeding of the sheet being started when or after the first time has elapsed from the predetermined timing in a case where the elapsed time is shorter than the first time.

18 Claims, 4 Drawing Sheets

IMAGE FORMING APPARATUS AND SHEET FEEDING METHOD

CROSS-REFERENCE TO RELATED APPLICATIONS

This application claims priority from Japanese Patent Application No. 2018-035643 filed on Feb. 28, 2018, the entire contents of which are incorporated herein by reference.

TECHNICAL FIELD

Aspects of the present disclosure relate to an image forming apparatus including a fixing device configured to heat a sheet and a sheet feeder configured to feed the sheet, and a sheet feeding method for the image forming apparatus.

BACKGROUND

In related art, an electrophotographic printer configured to change a timing, at which a sheet is to be fed, based on a temperature gradient when heating is started by a fixing device has been known. Specifically, according to this technology, the steeper the temperature gradient is, the earlier the feeding timing of the sheet is.

However, in a case where the temperature rises rapidly, for example, in a case where a power supply voltage is high, heat accumulation of the entire fixing device may not be sufficient even though the temperature, which is detected by a temperature detector provided to the fixing device, rises. In this case, when the feeding timing of the sheet is set earlier, like the related art, due to heat being drawn from the fixing device by a first sheet, a fixing defect may be caused.

SUMMARY

It is therefore an object of the present disclosure to suppress a fixing defect which is caused when heat is drawn from a fixing device by a first sheet.

According to an aspect of the disclosure, there is provided an image forming apparatus including: a sheet feeder configured to switch between a stopped state in which a sheet is stopped and a conveying state in which the sheet is conveyed; a developer image forming unit configured to form a developer image on the sheet; a fixing device including a heating unit configured to heat the sheet; a temperature detector configured to detect a temperature of the heating unit; and a controller, wherein, in a case where the temperature of the heating unit is lower than a first temperature lower than a fixing temperature when a printing command is received, the controller is configured to: heat the heating unit so that the temperature of the heating unit becomes the fixing temperature; acquire elapsed time which is time elapsed from a predetermined timing after start of the heating of the heating unit when the temperature of the heating unit has reached a second temperature higher than the first temperature and lower than the fixing temperature; and start feeding of the sheet based on the elapsed time, the feeding of the sheet being started based on a timing at which the temperature of the heating unit has reached the second temperature in a case where the elapsed time is equal to or longer than a first time, and the feeding of the sheet being started when the first time has elapsed from the predetermined timing or after the first time has elapsed from the predetermined timing in a case where the elapsed time is shorter than the first time.

According to another aspect of the disclosure, there is provided a sheet feeding method for an image forming apparatus including: a sheet feeder configured to switch between a stopped state in which a sheet is stopped and a conveying state in which the sheet is conveyed; a developer image forming unit configured to form a developer image on the sheet; and a fixing device including a heating unit configured to heat the sheet, the sheet feeding method including: in a case where the temperature of the heating unit is lower than a first temperature lower than a fixing temperature when a printing job is started: heating the heating unit so that the temperature of the heating unit becomes the fixing temperature; acquiring elapsed time which is time elapsed from a predetermined timing after start of the heating of the heating unit when the temperature of the heating unit has reached a second temperature higher than the first temperature and lower than the fixing temperature; and starting feeding of the sheet based on the elapsed time, the feeding of the sheet being started based on a timing at which the temperature of the heating unit has reached the second temperature in a case where the elapsed time is equal to or longer than a first time, and the feeding of the sheet being started when the first time has elapsed from the predetermined timing or after the first time has elapsed from the predetermined timing in a case where the elapsed time is shorter than the first time.

DETAILED DESCRIPTION

Hereinafter, an illustrative embodiment of the present disclosure will be described with reference to the drawings.

Figure 1:
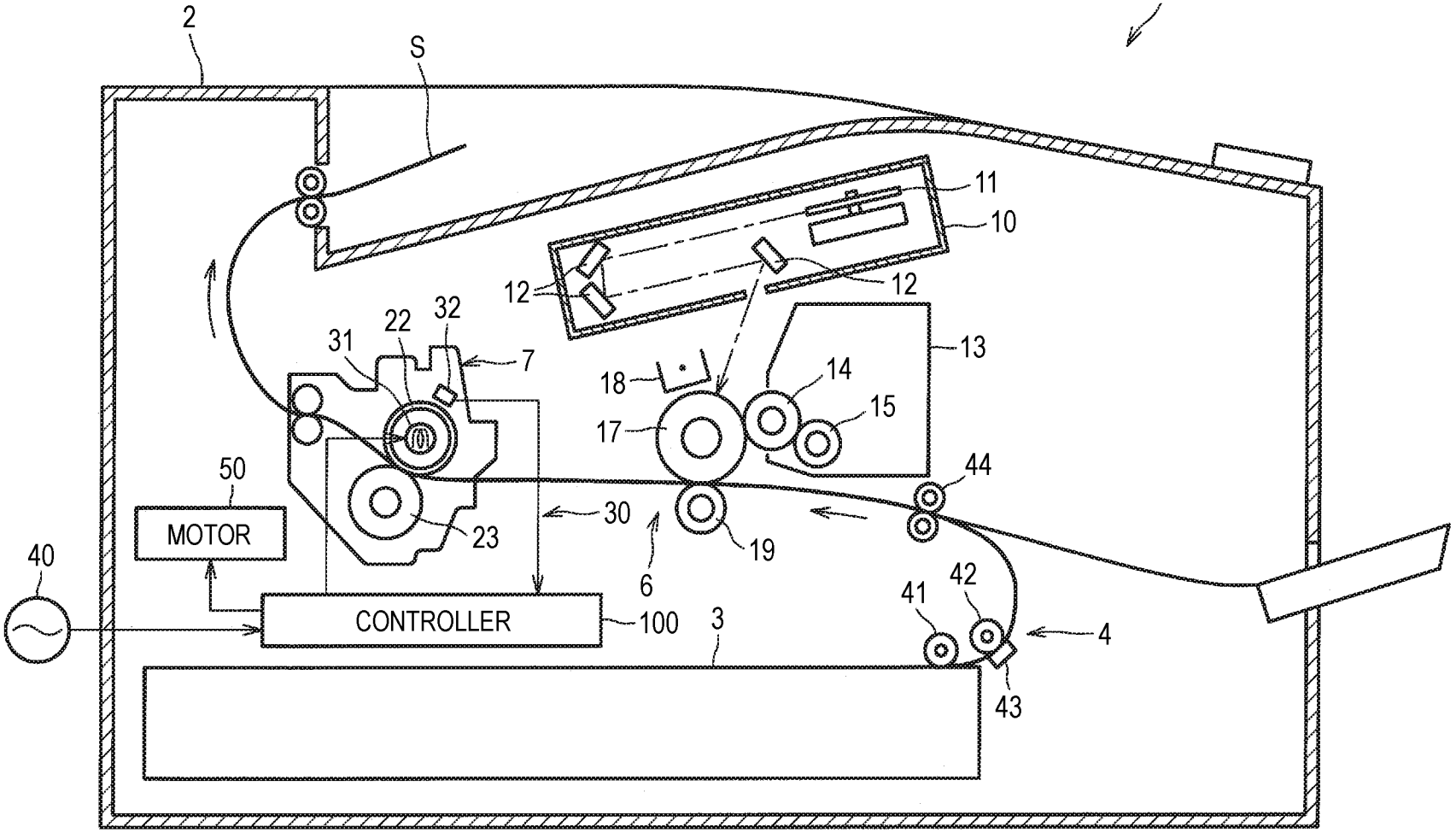
FIG. 1 is a sectional view of a printer in accordance with an illustrative embodiment.

As shown in FIG. 1, a printer 1 is an example of the electrophotographic image forming apparatus configured to form an image on a sheet S, and includes, in a main body casing 2, a feeding tray 3, a sheet conveying unit 4, a developer image forming unit 6, a fixing device 7, and a controller 100.

The sheet conveying unit 4 includes a pickup roller 41, which is an example of the sheet feeder, a separation roller 42, a separation pad 43, and registration rollers 44. The sheet conveying unit 4 is configured to feed the sheets S in the feeding tray 3 toward the separation roller 42 by the pickup roller 41, and to separate the sheets S one by one between the separation roller 42 and the separation pad 43. Specifically, the pickup roller 41 is a roller capable of switching between a stopped state in which the sheet S is stopped and a conveying state in which the sheet S is conveyed, and is configured to start rotation from a stop state where it is in contact with the sheet S in the feeding tray 3, thereby delivering the sheet S in the feeding tray 3. The registration rollers 44 are configured to align a position of a tip end of the sheet S and to convey the sheet S toward the developer image forming unit 6. Specifically, the registration rollers 44 are configured to contact the conveyed sheet S in a stopped state, to align the position of the tip end of the sheet S and to start rotation thereof, thereby delivering the sheet S. The sheet S delivered by the sheet conveying unit 4 passes through the developer image forming unit 6 and the fixing device 7 and is conveyed to an outside of the printer 1 in a conveying direction shown with an arrow.

The developer image forming unit 6 is configured to form a developer image on the sheet S, and includes an exposure device 10, a developing cartridge 13, a photosensitive drum 17, a charger 18, a transfer roller 19 and the like.

The exposure device 10 is arranged at an upper part in the main body casing 2, and is a laser scanner including a laser light-emitting unit (not shown), a polygon mirror 11, a plurality of reflectors 12, a plurality of lenses (not shown) and the like. The exposure device 10 is configured to scan laser light emitted from the laser light-emitting unit on a surface of the photosensitive drum 17 via the polygon mirror 11, the reflectors 12 and the lenses (not shown), as shown with a dashed-dotted line.

The developing cartridge 13 includes a developing roller 14 and a supply roller 15 configured to supply developer to the developing roller 14. In the developing cartridge 13, the developer that is dry toner is accommodated. The developing roller 14 is arranged to face the photosensitive drum 17. The developer in the developing cartridge 13 is supplied to the developing roller 14 by rotation of the supply roller 15 and is then carried on the developing roller 14.

The photosensitive drum 17 is configured to be charged by the charger 18 while being rotated. The photosensitive drum 17 is exposed by the laser light emitted from the exposure device 10, so that an electrostatic latent image is formed on a surface thereof. Then, the developer is supplied from the developing roller 14 to the electrostatic latent image on the photosensitive drum 17, so that a developer image is formed on the photosensitive drum 17. The developer image on the photosensitive drum 17 is transferred to the sheet S by a transfer bias applied to the transfer roller 19 while the sheet S passes between the photosensitive drum 17 and the transfer roller 19.

The fixing device 7 is arranged at a downstream side with respect to the developer image forming unit 6 in the conveying direction of the sheet S. The fixing device 7 includes a heating unit 22 configured to heat the sheet S and to fix the developer image on the sheet S and a pressing unit 23 that is to be pressed to the heating unit 22. The heating unit 22 is a cylindrical heating roller and is made of metal or the like. In the heating unit 22, a heater 31 for heating the heating unit 22 is provided. As the heater 31, a halogen heater having a filament (resistive element) and configured to heat a range of the heating unit 22, through which the sheet S is to pass, by radiation heat can be adopted. The controller 100 is configured to energize the heater 31 by ON/OFF controlling a voltage from an external alternating current power supply 40. The pressing unit 23 is a pressing roller having an elastic layer provided on a surface thereof.

The heating unit 22 and the pressing unit 23 are configured to rotate by a drive force applied from a motor 50 that is controlled by the controller 100. The fixing device 7 is configured to heat the sheet S by the heater 31 and to fix the developer image on the sheet S while sandwiching and conveying the sheet S between the heating unit 22 and the pressing unit 23 being rotated.

Also, the fixing device 7 includes a temperature detector 32 configured to detect a temperature of the heating unit 22. The temperature detector 32 is arranged to face a surface of the heating unit 22 without contact. The temperature detected by the temperature detector 32 is output to the controller 100. The controller 100 is configured to acquire the temperature of the heating unit 22, based on a detection result of the temperature detector 32.

Figure 2:
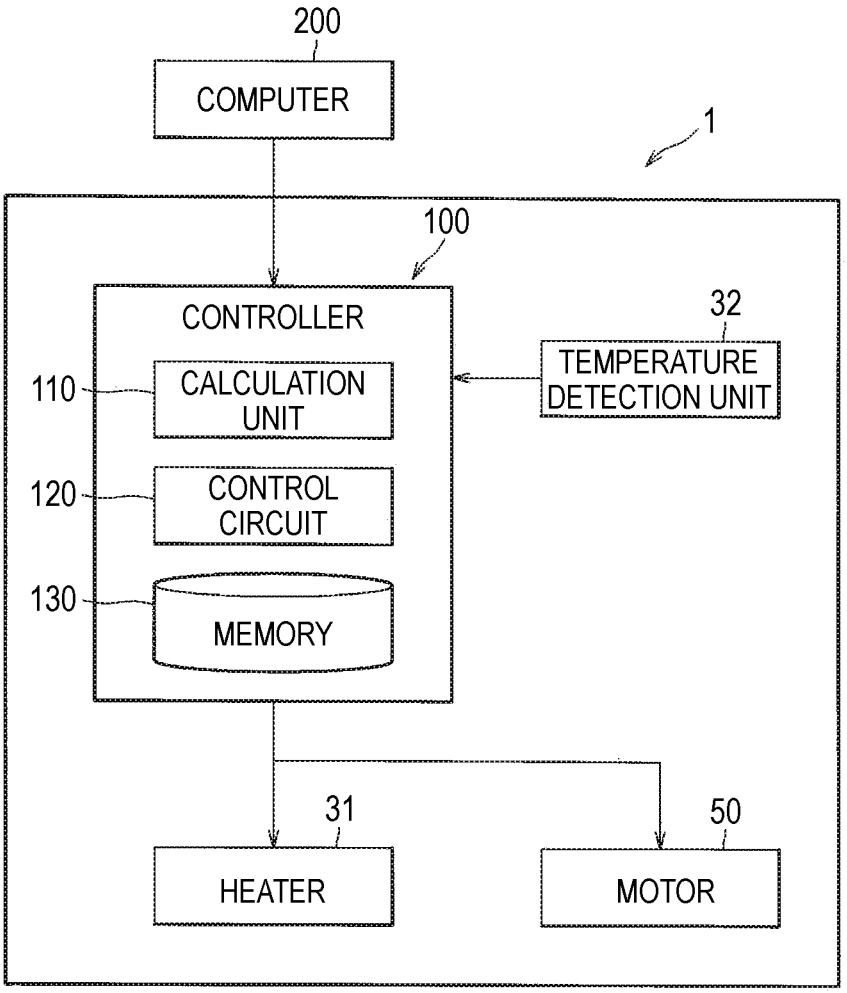
FIG. 2 is a block diagram depicting a configuration of a controller.

As shown in FIG. 2, the controller 100 includes a CPU, a RAM, a ROM and an input/output circuit, and is configured to execute control by performing a variety of calculation processing based on a printing command output from an external computer 200, information output from the temperature detector 32 and a program and data stored in the ROM and the like. Specifically, the controller 100 includes a calculation unit 110 such as a CPU, a control circuit 120 configured to control the heater 31, the motor 50 and the like, and a memory 130 such as a RAM and a ROM.

The controller 100 is configured to execute heating processing of heating the heating unit 22 so that the temperature of the heating unit 22 becomes a fixing temperature TH and feeding processing of feeding the sheet S by the pickup roller 41. In particular, the controller 100 has a function of changing a start timing of the feeding processing based on a temperature and a temperature gradient of the heating unit 22 when the printing command is received. The fixing temperature is a temperature that is set in correspondence to a thickness, a conveying speed and the like of the sheet S so as to fix the developer image, which has been formed on the sheet S, on the sheet S and is set as a predetermined fixing temperature TH, in the illustrative embodiment.

Specifically, in a case where the temperature of the heating unit 22 is equal to or higher than a first temperature T1 lower than the fixing temperature TH when the printing command is received so as to start a printing job, the controller 100 starts to feed the sheet S in the feeding processing when the temperature of the heating unit 22 has reached a second temperature T2 higher than the first temperature T1 and lower than the fixing temperature TH, irrespective of the temperature gradient (irrespective of an elapsed time from a predetermined timing, which will be described later).

Also, in a case where the temperature of the heating unit 22 is lower than the first temperature T1 when the printing command is received, the controller 100 changes the feeding start timing of the sheet S in correspondence to the temperature gradient of the heating unit 22. Specifically, in a case where the temperature of the heating unit 22 is lower than the first temperature T1 when the printing command is received, the controller 100 determines, in the feeding processing, whether the temperature gradient of the heating unit 22 is a steep gradient by determining whether the timing at which the temperature of the heating unit 22 has reached the second temperature T2 is before a first time Z1 has elapsed from a predetermined timing after the start of the heating processing.

In the illustrative embodiment, the predetermined timing is set as the timing at which the temperature of the heating unit 22 reaches the first temperature T1 after the start of the heating processing. Also, the controller 100 is configured to rotate the motor 50 and to start the drive of the fixing device 7, specifically, the rotations of the heating unit 22 and the pressing unit 23 at the predetermined timing, i.e., at the timing at which the temperature of the heating unit 22 has reached the first temperature T1.

In a case where it is determined that the timing at which the temperature of the heating unit 22 has reached the second temperature T2 is before the first time Z1 has elapsed from the predetermined timing after the start of the heating processing, i.e., the temperature gradient is a steep gradient, the controller 100 waits at least until the first time Z1 has elapsed from the predetermined timing and starts to feed the sheet S when the first time Z1 has elapsed or after the first time Z1 has elapsed. Specifically, in a case where the temperature of the heating unit 22 has reached the second temperature T2 before the first time Z1 has elapsed from the predetermined timing, the controller 100 starts to feed the sheet S in the feeding processing when a second time Z2 longer than the first time Z1 has elapsed from the predetermined timing.

Also, in a case where it is determined that the timing at which the temperature of the heating unit 22 has reached the second temperature T2 is after the first time Z1 has elapsed from the predetermined timing and before a third time Z3 longer than the first time Z1 has elapsed, i.e., the temperature gradient is a medium gradient smaller than the steep gradient, the controller 100 starts to feed the sheet S when the temperature of the heating unit 22 has reached the second temperature T2.

Also, in a case where it is determined that the timing at which the temperature of the heating unit 22 has reached the second temperature T2 is after the third time Z3 has elapsed from the predetermined timing, i.e., the temperature gradient is a gentle gradient smaller than the medium gradient, the controller 100 starts to feed the sheet S when the temperature of the heating unit 22 has reached a third temperature T3 higher than the second temperature T2.

In the below, the operation of the controller 100 is described in detail with reference to a flowchart of FIG. 3.

Figure 3:
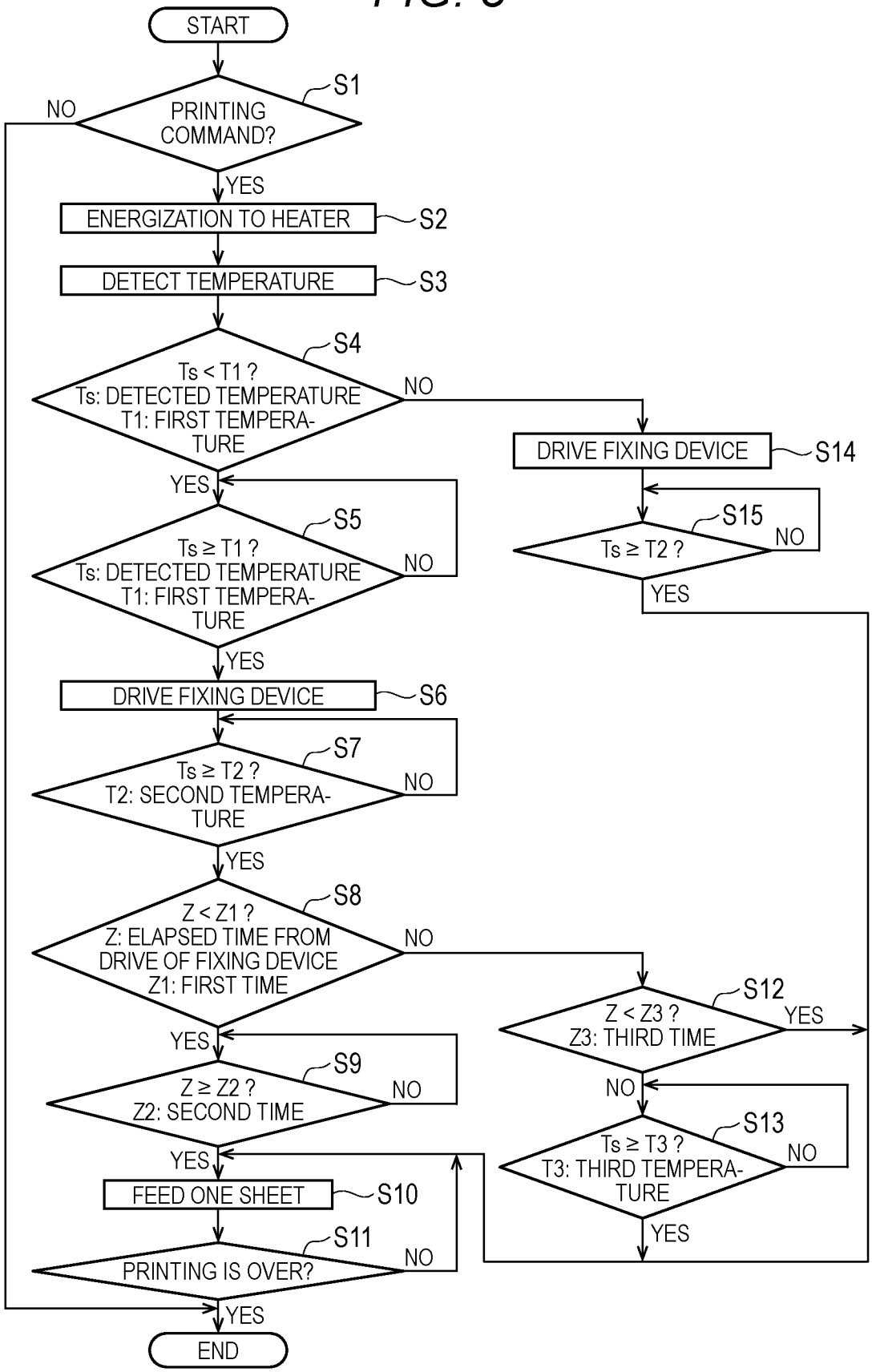
FIG. 3 is a flowchart depicting an operation of the controller.

As shown in FIG. 3, the controller 100 determines whether a printing command has been received (S1). In a case where it is determined in step S1 that a printing command has not been received (No), the controller 100 ends the control.

In a case where it is determined in step S1 that a printing command has been received (Yes), the controller 100 starts energization to the heater 31, thereby starting the heating processing (S2). After step S2, the controller 100 starts to detect the temperature of the heating unit 22 by the temperature detector 32 (S3).

After step S3, the controller 100 determines whether a detected temperature Ts detected by the temperature detector 32 is lower than the first temperature T1 lower than the fixing temperature TH (S4). In a case where it is determined in step S4 that a relation of Ts<T1 is satisfied (Yes), the controller 100 determines whether the detected temperature Ts becomes equal to or higher than the first temperature T1 (S5).

The controller 100 repetitively executes the processing of step S5 until it is determined in step S5 that a relation of Ts≥T1 is satisfied (No). In a case where it is determined that the relation of Ts≥T1 is satisfied (Yes), the controller 100 rotates the motor 50 to start the drive of the fixing device 7, i.e., the rotations of the heating unit 22 and the pressing unit 23 (S6).

After step S6, the controller 100 determines whether the detected temperature Ts becomes equal to or higher than the second temperature T2 higher than the first temperature T1 and lower than the fixing temperature TH (S7). The controller 100 repetitively executes the processing of step S6 until it is determined in step S7 that a relation of Ts≥T2 is satisfied (No). In a case where it is determined that the relation of Ts≥T2 is satisfied (Yes), the controller 100 determines whether the elapsed time Z from the drive start of the fixing device 7 is shorter than the first time Z1, i.e., whether the temperature gradient is the steep gradient (S8). Here, since the drive of the fixing device 7 is enabled to start at a timing at which the relation of Ts≥T1 is satisfied (S5: Yes), the elapsed time Z from the drive start of the fixing device 7 is equivalent to the elapsed time from the timing at which the detected temperature Ts has reached the first temperature T1.

In a case where it is determined in step S8 that a relation of Z<Z1 is satisfied (Yes), the controller 100 determines whether the elapsed time Z becomes equal to or longer than a second time Z2 longer than the first time Z1 (S9). The controller 100 repetitively executes the processing of step S9 until it is determined in step S9 that a relation of Z≥Z2 is satisfied (No). When it is determined that the relation of Z≥Z2 is satisfied (Yes), the controller 100 drives the pickup roller 41 to feed one sheet S (S10).

After step S10, the controller 100 determines whether the printing is over (S11). In a case where it is determined in step S11 that the printing is not over (No), the controller 100 returns to step S10 and feeds the second sheet S and thereafter at predetermined timings. Specifically, the second sheet S and thereafter are fed at preset timings so that an interval between the sheets S is a predetermined interval, in such a manner that this time sheet S is fed after predetermined time has elapsed from the previous feeding of the sheet S, for example.

In a case where it is determined in step S11 that the printing is over (Yes), the controller 100 ends the control.

In a case where it is determined in step S8 that the relation of Z<Z1 is not satisfied (No), the controller 100 determines whether the elapsed time Z is shorter than a third time Z3 longer than the first time Z1, i.e., whether the temperature gradient is the medium gradient (S12). In a case where it is determined in step S12 that a relation of Z<Z3 is satisfied, the controller 100 proceeds to step S10 and feeds one sheet S. That is, in a case where the temperature gradient is the medium gradient, the controller 100 starts to feed the sheet S at substantially the same timing as the time (S7) that the detected temperature Ts has reached the second temperature T2 (S10).

In a case where it is determined in step S12 that the relation of Z<Z3 is not satisfied, i.e., in a case where the temperature gradient is the gentle gradient (No), the controller 100 determines whether the detected temperature Ts becomes equal to or higher than the third temperature T3 higher than the second temperature T2 and lower than the fixing temperature TH (S13). The controller 100 repetitively executes the processing of step S13 until it is determined in step S13 that the relation of Ts≥T3 is satisfied (No). In a case where it is determined that the relation of Ts≥T3 is satisfied (Yes), the controller 100 starts to feed the sheet S (S10).

In a case where it is determined in step S4 that the relation of Ts<T1 is not satisfied (No), the controller 100 starts to drive the fixing device 7 (S14). After step S14, the controller 100 determines whether the detected temperature Ts becomes equal to or higher than the second temperature T2 (S15). The controller 100 repetitively executes the processing of step S15 until it is determined in step S15 that the relation of Ts≥T2 is satisfied (No). In a case where it is determined that the relation of Ts≥T2 is satisfied (Yes), the controller 100 starts to feed the sheet S (S10).

Subsequently, an example of the operation of the controller 100 is described in detail.

Figure 4:
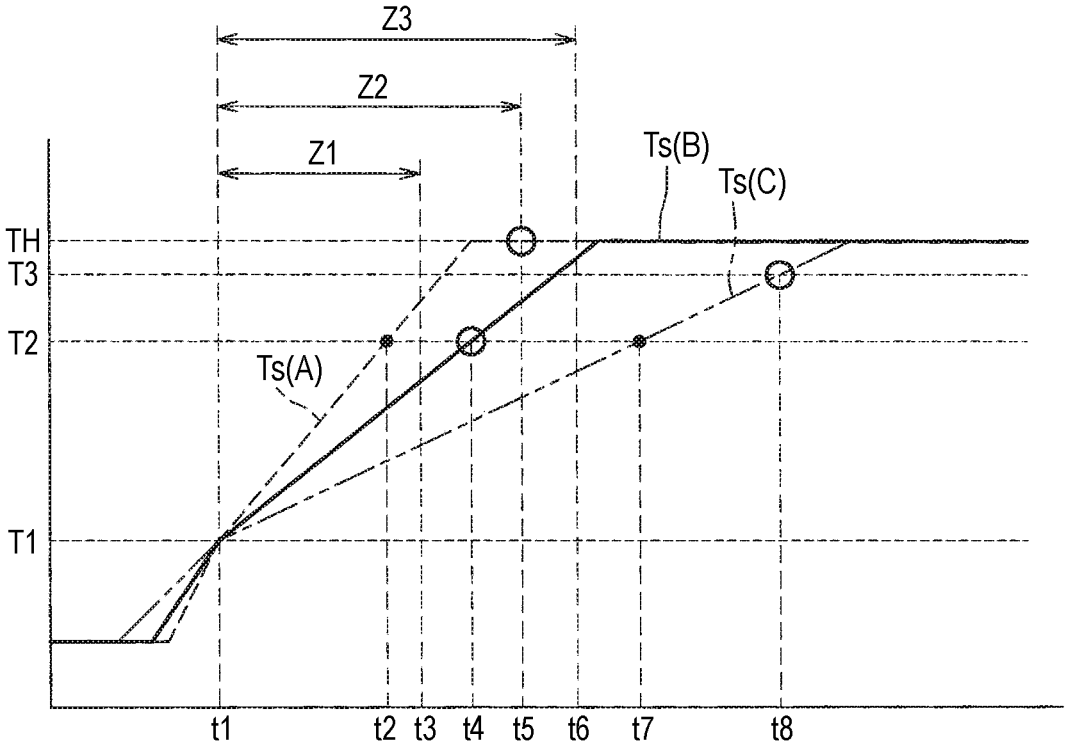
FIG. 4 is a timing chart depicting an example of the operation of the controller.

In FIG. 4, an example shown with a broken line as the detected temperature Ts(A) indicates a condition with which the temperature gradient becomes the steep gradient in a case where the voltage of the power supply 40 is high, for example. In a case where the detected temperature Ts reaches the second temperature T2 (time t2) before the first time Z1 has elapsed (before time t3) from the predetermined timing (time t1), which is the timing at which the detected temperature Ts has reached the first temperature T1, since the temperature gradient is the steep gradient, there is a possibility that the heat has not been sufficiently accumulated in the heating unit 22. For this reason, in a case where the temperature gradient is the steep gradient, the controller 100 does not start feeding the sheet S even though the detected temperature Ts has reached the second temperature T2, and starts to feed the sheet S when the second time Z2 has elapsed from the predetermined timing (time t5). In this manner, in a case where the heat accumulation of the heating unit 22 is not sufficient, the feeding start timing of the sheet S is delayed, so that it is possible to wait until the heat will be sufficiently accumulated in the heating unit 22. Therefore, it is possible to suppress a fixing defect even when heat is drawn from the heating unit 22 or the like by the first sheet S.

In FIG. 4, an example shown with a solid line as the detected temperature Ts(B) indicates a condition with which the temperature gradient becomes the medium gradient. In a case where the detected temperature Ts reaches the second temperature T2 (time t4) after the first time Z1 has elapsed from the predetermined timing (time t1) and before the third time Z3 has elapsed from the predetermined timing (time t3 to t6), since the temperature gradient is the medium gradient, it is thought that the heat has been sufficiently accumulated in the heating unit 22. For this reason, in a case where the temperature gradient is the medium gradient, the controller 100 starts to feed the sheet S when the detected temperature Ts has reached the second temperature T2 (time t4). In this manner, in a case where the heat is sufficiently accumulated in the heating unit 22, the feeding of the sheet S is started when the detected temperature Ts has reached the second temperature T2, so that it is possible to promptly perform the printing.

In FIG. 4, an example shown with a dashed-two dotted line as the detected temperature Ts(C) indicates a condition with which the temperature gradient becomes the gentle gradient in a case where the voltage of the power supply 40 is low, for example. In a case where the detected temperature Ts reaches the second temperature T2 (time t7) after the third time Z3 has elapsed (after time t6) from the predetermined timing (time t1), the temperature gradient is the gentle gradient. Therefore, if the sheet S is fed at the timing at which the detected temperature Ts has reached the second temperature T2, there is a possibility that the temperature of the heating unit 22 has not reached the fixing temperature TH when the sheet S has reached the heating unit 22. For this reason, in a case where the temperature gradient is the gentle gradient, the controller 100 does not start feeding the sheet S even though the detected temperature Ts has reached the second temperature T2, and starts to feed the sheet S when the detected temperature Ts has reached the third temperature T3 higher than the second temperature T2 (time t8). In this manner, in a case where the temperature gradient is the gentle gradient, the feeding of the sheet S is started when the detected temperature Ts has reached the third temperature T3 higher than the second temperature T2. Therefore, since it is possible to increase the temperature of the heating unit 22 to the fixing temperature TH or higher when the sheet S has reached the heating unit 22, it is possible to suppress the fixing defect on the first sheet S.

According to the illustrative embodiment, it is possible to accomplish the following effects, in addition to the above-described effects.

Since the predetermined timing is determined based on the timing at which the detected temperature Ts has reached the first temperature T1, i.e., the predetermined timing is determined based on the temperature, it is possible to perceive the rising gradient of the temperature with higher accuracy.

In a case where the temperature of the heating unit 22 is equal to or higher than the first temperature T1 when the printing command is received, i.e., in a case where there is a high possibility that the heat has been sufficiently accumulated in the heating unit 22, since the feeding of the sheet S is started at the timing at which the detected temperature Ts has reached the second temperature T2, it is possible to promptly perform the printing.

In the meantime, the present disclosure is not limited to the illustrative embodiment, and can be implemented in various forms as exemplified below. In the below descriptions, the members having substantially the same structures as the illustrative embodiment are denoted with the same reference numerals, and the descriptions thereof are omitted.

In the above illustrative embodiment, in a case where the elapsed time Z is equal to or longer than the first time Z1 and is shorter than the third time Z3 (S8: No→S12: Yes) or in a case where the detected temperature Ts is equal to or higher than the first temperature T1 when the printing command is received (S4: No), the feeding of the sheet S is started when the detected temperature Ts has reached the second temperature T2. However, the present disclosure is not limited thereto. That is, in the above cases, the sheet feeding start timing may be determined based on the timing at which the detected temperature Ts has reached the second temperature T2. For example, the sheet feeding may be started after a predetermined time from the timing at which the detected temperature Ts has reached the second temperature T2.

In the above illustrative embodiment, in a case where the detected temperature Ts has reached the second temperature T2 before the first time Z1 has elapsed from the predetermined timing (S7: Yes→S8: Yes), the feeding of the sheet S is started when the elapsed time Z from the predetermined timing becomes the second time Z2 or longer. However, the present disclosure is not limited thereto. In this case, the sheet feeding start timing may be determined based on that the second time Z2 has elapsed from the predetermined timing. For example, the sheet feeding may be enabled to start in a case where a condition that the temperature has reached a predetermined temperature higher than the second temperature T2 is satisfied, in addition to the condition of the second time Z2. Also, in a case where the detected temperature Ts has reached the second temperature T2 before the first time Z1 has elapsed from the predetermined timing, the sheet feeding may be enabled to start when the first time Z1 has elapsed from the predetermined timing, without considering the second time Z2.

In the above illustrative embodiment, the printing command is output from the external computer 200. However, the present disclosure is not limited thereto. For example, when data for print is acquired from a recording medium connected to the printer 1 or when data for print is read from a reading device provided to the printer 1, it may be assumed that the printing command is received.

In the above illustrative embodiment, as the predetermined timing, the timing at which the temperature of the heating unit 22 has reached the first temperature T1 after starting the heating processing has been exemplified. However, the present disclosure is not limited thereto. For example, the timing at which the heating processing has started may be used as the predetermined timing.

In the above illustrative embodiment, the motor 50 is rotated to drive the fixing device 7. However, the present disclosure is not limited thereto. For example, when the fixing device is coupled to the motor via a clutch, the controller may start to drive the fixing device by turning the clutch ON.

In the above illustrative embodiment, as the sheet feeder, the pickup roller 41 has been exemplified. However, the present disclosure is not limited thereto. For example, the sheet feeder may be any member capable of switching between stopping and conveyance of the sheet S by the controller 100. For example, the sheet feeder may be the registration rollers 44, a supply roller for feeding the sheet on a manual tray, or the like.

The sheet S may be a sheet such as a thick sheet, a postcard, a thin sheet and the like, an OHP sheet and the like.

The developer image forming unit is arbitrarily configured. For example, a developer image forming unit configured to expose the photosensitive drum by an LED head as the exposure device is also possible.

In the above illustrative embodiment, as the heating unit 22, the cylindrical heating roller has been exemplified. However, the present disclosure is not limited thereto. For example, the heating unit may be a nip plate configured to sandwich an endless belt between the nip plate and the pressing unit.

In the above illustrative embodiment, as the heater 31, the halogen heater having the filament (resistive element) and configured to heat the heating unit 22 by the radiation heat has been exemplified. However, the present disclosure is not limited thereto. For example, the heater 31 may be a ceramic heater having a resistive heat-generating element and configured to heat the heating unit 22 by thermal conduction.

In the above illustrative embodiment, the temperature detector 32 without contact with the surface of the heating unit 22 has been exemplified. However, the present disclosure is not limited thereto. For example, the temperature detector may be in contact with the surface of the heating unit 22.

In the above illustrative embodiment, the present disclosure has been applied to the printer 1. However, the present disclosure is not limited thereto. For example, the present disclosure can also be applied to other image forming apparatuses, for example, a copier, a complex machine and the like.

Also, the respective elements described in the illustrative embodiment and the modified embodiments thereof may be implemented with being arbitrarily combined.

The disclosure provides illustrative, non-limiting examples as follows:

According to an aspect of the disclosure, there is provided an image forming apparatus including: a sheet feeder configured to switch between a stopped state in which a sheet is stopped and a conveying state in which the sheet is conveyed; a developer image forming unit configured to form a developer image on the sheet; a fixing device including a heating unit configured to heat the sheet; a temperature detector configured to detect a temperature of the heating unit; and a controller, wherein, in a case where the temperature of the heating unit is lower than a first temperature lower than a fixing temperature when a printing command is received, the controller is configured to: heat the heating unit so that the temperature of the heating unit becomes the fixing temperature; acquire elapsed time which is time elapsed from a predetermined timing after start of the heating of the heating unit when the temperature of the heating unit has reached a second temperature higher than the first temperature and lower than the fixing temperature; and start feeding of the sheet based on the elapsed time, the feeding of the sheet being started based on a timing at which the temperature of the heating unit has reached the second temperature in a case where the elapsed time is equal to or longer than a first time, and the feeding of the sheet being started when the first time has elapsed from the predetermined timing or after the first time has elapsed from the predetermined timing in a case where the elapsed time is shorter than the first time.

According to the above configuration, in a case where the elapsed time is shorter than the first time, since a rising gradient of the temperature is large and the heat accumulation of the heating unit may not be sufficient, the timing of starting feeding of the sheet is delayed, so that it is possible to wait until the heat is sufficiently accumulated in the heating unit. For this reason, it is possible to suppress a fixing defect which is caused when heat is drawn from the fixing device by the first sheet.

In the case where the elapsed time is shorter than the first time, the controller may be configured to start the feeding of the sheet based on that a second time longer than the first time has elapsed from the predetermined timing.

In a case where the elapsed time is equal to or longer than a third time longer than the first time, the controller may be configured to start the feeding of the sheet based on that the temperature of the heating unit has reached a third temperature higher than the second temperature.

In a case where the elapsed time is equal to or longer than a third time longer than the first time, the rising gradient of the temperature is too small. Therefore, if the sheet is fed at a timing at which the temperature of the heating unit has reached the second temperature, the temperature of the heating unit may not reach the fixing temperature when the sheet has reached the heating unit. For this reason, in this case, the timing of starting the feeding of the sheet is delayed, so that when the sheet reaches the heating unit, the temperature of the heating unit can be made equal to or higher than the fixing temperature. Therefore, it is possible to suppress the fixing defect on the first sheet.

The predetermined timing may be a timing at which the temperature of the heating unit has reached the first temperature after the heating of the heating unit has been started.

According to the above configuration, the predetermined timing is determined based on the temperature, so that it is possible to perceive the rising gradient of the temperature with higher accuracy.

The controller may be configured to start rotating the heating unit at the timing at which the temperature of the heating unit has reached the first temperature.

In a case where the temperature of the heating unit is equal to or higher than the first temperature when the printing command is received, the controller may be configured to: heat the heating unit so that the temperature of the heating unit becomes the fixing temperature; and start feeding of the sheet based on the timing at which the temperature of the heating unit has reached the second temperature.

In a case where the temperature of the heating unit is equal to or higher than the first temperature when the printing command is received, there is a high possibility that the heat has been sufficiently accumulated in the heating unit. Therefore, by starting the sheet feeding at the timing at which the heating unit has reached the second temperature, it is possible to promptly perform the printing.

According to another aspect of the disclosure, there is provided a sheet feeding method for an image forming apparatus including: a sheet feeder configured to switch between a stopped state in which a sheet is stopped and a conveying state in which the sheet is conveyed; a developer image forming unit configured to form a developer image on the sheet; and a fixing device including a heating unit configured to heat the sheet, the sheet feeding method including: in a case where the temperature of the heating unit is lower than a first temperature lower than a fixing temperature when a printing job is started: heating the heating unit so that the temperature of the heating unit becomes the fixing temperature; acquiring elapsed time which is time elapsed from a predetermined timing after start of the heating of the heating unit when the temperature of the heating unit has reached a second temperature higher than the first temperature and lower than the fixing temperature; and starting feeding of the sheet based on the elapsed time, the feeding of the sheet being started based on a timing at which the temperature of the heating unit has reached the second temperature in a case where the elapsed time is equal to or longer than a first time, and the feeding of the sheet being started when the first time has elapsed from the predetermined timing or after the first time has elapsed from the predetermined timing in a case where the elapsed time is shorter than the first time.

In the case where the elapsed time is shorter than the first time, the feeding of the sheet may be started based on that a second time longer than the first time has elapsed from the predetermined timing.

In a case where the elapsed time is equal to or longer than a third time longer than the first time, the feeding of the sheet may be started based on that the temperature of the heating unit has reached a third temperature higher than the second temperature.

The predetermined timing may be a timing at which the temperature of the heating unit has reached the first temperature after the heating of the heating unit has been started.

The sheet feeding method may further include: start rotating the heating unit at the timing at which the temperature of the heating unit has reached the first temperature.

The sheet feeding method may further include: in a case where the temperature of the heating unit is equal to or higher than the first temperature when the printing job is started: heating the heating unit so that the temperature of the heating unit becomes the fixing temperature; and starting feeding of the sheet based on the timing at which the temperature of the heating unit has reached the second temperature.

What is claimed is:

1. An image forming apparatus comprising:

a sheet feeder configured to switch between a stopped state in which a sheet is stopped and a conveying state in which the sheet is conveyed;

a developer image forming unit configured to form a developer image on the sheet;

a fixing device including a heating unit configured to heat the sheet;

a temperature detector configured to detect a temperature of the heating unit; and a controller, wherein, in a case where the temperature of the heating unit is lower than a first temperature lower than a fixing temperature when a printing command is received, the controller is configured to:

perform a heating process of heating the heating unit so that the temperature of the heating unit becomes the fixing temperature;

acquire elapsed time which is time elapsed from a predetermined timing after starting the heating process when, during the heating process, the temperature of the heating unit has reached a second temperature higher than the first temperature and lower than the fixing temperature;

determine whether the elapsed time is equal to or longer than a first time; and start feeding of the sheet based on the elapsed time, the feeding of the sheet being started based on a timing at which the temperature of the heating unit has reached the second temperature in a case where the elapsed time is determined to be equal to or longer than the first time, and the feeding of the sheet being started when the first time has elapsed from the predetermined timing or after the first time has elapsed from the predetermined timing in a case where the elapsed time is determined to be shorter than the first time.

2. The image forming apparatus according to claim 1, wherein, in the case where the elapsed time is determined to be shorter than the first time, the controller is configured to start the feeding of the sheet based on a second time longer than the first time having elapsed from the predetermined timing.

3. The image forming apparatus according to claim 1, wherein, in a case where the elapsed time is equal to or longer than a third time longer than the first time, the controller is configured to start the feeding of the sheet based on the temperature of the heating unit having reached a third temperature higher than the second temperature.

4. The image forming apparatus according to claim 1, wherein the predetermined timing is a timing at which the temperature of the heating unit has reached the first temperature after the heating process has been started.

5. The image forming apparatus according to claim 1, wherein the controller is configured to start rotating the heating unit at the timing at which the temperature of the heating unit has reached the first temperature.

6. The image forming apparatus according to claim 1, wherein, in a case where the temperature of the heating unit is equal to or higher than the first temperature when the printing command is received, the controller is configured to:

heat the heating unit so that the temperature of the heating unit becomes the fixing temperature; and start feeding of the sheet based on the timing at which the temperature of the heating unit has reached the second temperature.

7. A sheet feeding method for an image forming apparatus including:

a sheet feeder configured to switch between a stopped state in which a sheet is stopped and a conveying state in which the sheet is conveyed; a developer image forming unit configured to form a developer image on the sheet; and a fixing device including a heating unit configured to heat the sheet, the sheet feeding method comprising:

in a case where a temperature of the heating unit is lower than a first temperature lower than a fixing temperature when a printing job is started:

perform a heating process of heating the heating unit so that the temperature of the heating unit becomes the fixing temperature;

acquiring elapsed time which is time elapsed from a predetermined timing after starting the heating process when, during the heating process, the temperature of the heating unit has reached a second temperature higher than the first temperature and lower than the fixing temperature;

determine whether the elapsed time is equal to or longer than a first time or shorter; and starting feeding of the sheet based on the elapsed time, the feeding of the sheet being started based on a timing at which the temperature of the heating unit has reached the second temperature in a case where the elapsed time is determined to be equal to or longer than the first time, and the feeding of the sheet being started when the first time has elapsed from the predetermined timing or after the first time has elapsed from the predetermined timing in a case where the elapsed time is determined to be shorter than the first time.

8. The sheet feeding method according to claim 7, wherein, in the case where the elapsed time is determined to be shorter than the first time, the feeding of the sheet is started based on that a second time longer than the first time has elapsed from the predetermined timing.

9. The sheet feeding method according to claim 7, wherein, in a case where the elapsed time is equal to or longer than a third time longer than the first time, the feeding of the sheet is started based on the temperature of the heating unit having reached a third temperature higher than the second temperature.

10. The sheet feeding method according to claim 7, wherein the predetermined timing is a timing at which the temperature of the heating unit has reached the first temperature after the heating process has been started.

11. The sheet feeding method according to claim 7, further comprising:

start rotating the heating unit at the timing at which the temperature of the heating unit has reached the first temperature.

12. The sheet feeding method according to claim 7, further comprising:

in a case where the temperature of the heating unit is equal to or higher than the first temperature when the printing job is started:

heating the heating unit so that the temperature of the heating unit becomes the fixing temperature; and start feeding of the sheet based on the timing at which the temperature of the heating unit has reached the second temperature.

13. An image forming apparatus comprising:

a sheet feeder configured to switch between a stopped state in which a sheet is stopped and a conveying state in which the sheet is conveyed;

a developer image forming unit configured to form a developer image on the sheet;

a heating roller configured to heat the sheet;

a halogen heater configured to heat the heating roller;

a temperature detector configured to detect a temperature of the heating roller; and a controller, wherein, in a case where the temperature of the heating roller is lower than a first temperature lower than a fixing temperature when a printing command is received, the controller is configured to:

perform an energizing process of energizing the halogen heater so that the temperature of the heating roller becomes the first fixing temperature;

acquire elapsed time which is time elapsed from a predetermined timing after starting the energizing process when, during the energizing process, the temperature of the heating roller has reached a second temperature higher than the first temperature and lower than the fixing temperature;

determine whether the elapsed time is equal to or longer than a first time; and start feeding of the sheet based on the elapsed time, the feeding of the sheet being started based on a timing at which the temperature of the heating roller has reached the second temperature in a case where the elapsed time is determined to be equal to or longer than the first time, and the feeding of the sheet being started when the first time has elapsed from the predetermined timing or after the first time has elapsed from the predetermined timing in a case where the elapsed time is determined to be shorter than the first time.

14. The image forming apparatus according to claim 13, wherein, in the case where the elapsed time is determined to be shorter than the first time, the controller is configured to start the feeding of the sheet based on a second time longer than the first time having elapsed from the predetermined timing.

15. The image forming apparatus according to claim 13, wherein, in a case where the elapsed time is equal to or longer than a third time longer than the first time, the controller is configured to start the feeding of the sheet based on the temperature of the heating roller having reached a third temperature higher than the second temperature.

16. The image forming apparatus according to claim 13, wherein the predetermined timing is a timing at which the temperature of the heating roller has reached the first temperature after the energizing process has been started.

17. The image forming apparatus according to claim 13, wherein the controller is configured to start rotating the heating roller at the timing at which the temperature of the heating roller has reached the first temperature.

18. The image forming apparatus according to claim 13, wherein, in a case where the temperature of the heating roller is equal to or higher than the first temperature when the printing command is received, the controller is configured to:

energize the halogen heater so that the temperature of the heating roller becomes the fixing temperature; and start feeding of the sheet based on the timing at which the temperature of the heating roller has reached the second temperature.

* * * * *